US008916822B2

(12) United States Patent
Wright et al.

(10) Patent No.: US 8,916,822 B2
(45) Date of Patent: Dec. 23, 2014

(54) DUAL-DETECTION RESIDUAL GAS ANALYZER

(71) Applicant: INFICON Inc., East Syracuse, NY (US)

(72) Inventors: Kenneth Charles Wright, Fayetteville, NY (US); John James DeSantis, DeWitt, NY (US)

(73) Assignee: Inficon, Inc., East Syracuse, NY (US)

( * ) Notice: Subject to any disclaimer, the term of this patent is extended or adjusted under 35 U.S.C. 154(b) by 0 days.

(21) Appl. No.: 14/134,300

(22) Filed: Dec. 19, 2013

(65) Prior Publication Data

US 2014/0166878 A1 Jun. 19, 2014

Related U.S. Application Data

(60) Provisional application No. 61/739,492, filed on Dec. 19, 2012.

(51) Int. Cl.
*H01J 49/00* (2006.01)
*H01J 49/06* (2006.01)

(52) U.S. Cl.
CPC ..... *H01J 49/061* (2013.01)
USPC ..... 250/288; 250/281; 250/282; 250/283; 250/287; 250/423 R

(58) Field of Classification Search
USPC ..... 250/281–282, 287, 288, 423 R
See application file for complete search history.

(56) References Cited

U.S. PATENT DOCUMENTS 4,692,630 A 9/1987 Gogol
4,988,871 A 1/1991 Gogol
5,808,308 A 9/1998 Holkeboer
5,814,823 A 9/1998 Benveniste
5,850,084 A 12/1998 Holkeboer
5,889,281 A 3/1999 Holkeboer et al.
6,091,068 A * 7/2000 Parfitt et al. ..... 250/292
6,468,814 B1 10/2002 Frees et al.
RE38,138 E 6/2003 Holkeboer et al.
6,642,641 B2 11/2003 Ellefson et al.
6,740,195 B2 5/2004 Frees et al.
7,041,984 B2 5/2006 Ellefson et al.
7,230,237 B2 6/2007 Ueno (Continued)

OTHER PUBLICATIONS

International Search Report & Written Opinion, Application No. PCT/US2013/076641, Applicant, INFICON Inc., mailed Apr. 15, 2014, 13 pages.

(Continued)

*Primary Examiner* — Jack Berman
*Assistant Examiner* — Meenakshi Sahu
(74) *Attorney, Agent, or Firm* — Hiscock & Barclay LLP

(57) ABSTRACT

A detector in a residual gas analyzer (RGA) is configured to receive ions traveling in a downstream direction along a beamline and includes a steering electrode offset from the beamline. A first ion-receiving electrode is at least partly on the opposite side of the steering electrode from the beamline. A second ion-receiving electrode is at least partly offset from the beamline, at least partly across the beamline from at least a portion of the steering electrode, and at least partially upstream of at least a portion of the steering electrode. A shielding electrode is arranged at least partly between the beamline and the second ion-receiving electrode. A source applies a potential to the shielding electrode. A residual gas analyzer (RGA) includes an ion source, an analyzer, and such a detector.

20 Claims, 7 Drawing Sheets

(56) References Cited

U.S. PATENT DOCUMENTS

| | | | |
|---|---|---|---|
| 7,257,494 | B2 | 8/2007 | Conner et al. |
| 2002/0153820 | A1 | 10/2002 | Ellefson et al. |
| 2003/0008422 | A1 | 1/2003 | Frees et al. |
| 2003/0155496 | A1 | 8/2003 | Kalinitchenko |
| 2005/0256653 | A1 | 11/2005 | Conner et al. |
| 2005/0258374 | A1 | 11/2005 | Ellefson et al. |
| 2008/0048663 | A1 | 2/2008 | Hong et al. |
| 2009/0014644 | A1 | 1/2009 | Yang et al. |
| 2010/0134116 | A1 | 6/2010 | Ikeda et al. |

OTHER PUBLICATIONS

Transpector 2 Gas Analysis System, by INFICON Holding AG, published in 2009, 6 pages.

* cited by examiner

DUAL-DETECTION RESIDUAL GAS ANALYZER

CROSS-REFERENCE TO RELATED APPLICATIONS

This nonprovisional application claims the benefit of U.S. Provisional Patent Application Ser. No. 61/739,492, filed Dec. 19, 2012, and entitled "Dual-Detection Residual Gas Analyzer," the entirety of which is incorporated herein by reference.

TECHNICAL FIELD

The present application relates to measuring gas concentrations or gas partial pressures in chambers.

BACKGROUND

Vacuum chambers and other vacuum systems, together with residual gas analyzers (RGAs), can be used in various processes or devices. Examples include coating machines for semiconductors or non-semiconductors, including physical vapor deposition (PVD) machines, chemical vapor deposition (CVD) machines, and atomic layer deposition (ALD) machines; leak detection; atmospheric measurement systems, e.g., used at oil-drilling sites; food or pharmaceutical analysis systems; chemical weapons detectors; particle accelerators; and research and development equipment.

For example, the process of making semiconductors, e.g., integrated-circuit transistors, involves numerous processes carried out under very low pressures. These pressures are maintained in what are commonly referred to as "vacuum chambers." In general, a vacuum chamber is an enclosure connected to a pumping system, e.g., one including a cryo pump or turbopump. The pumping system maintains low or extremely low pressures, e.g., $10^{-8}$ Torr for a base pressure or 5 mTorr during processing. The pumping system can maintain specified concentrations of selected gasses in the chamber. A "vacuum tool" is a device that includes one or more vacuum chamber(s) and facilities to transfer workpieces in and out of the vacuum chamber(s). An example of a vacuum tool, specifically a cluster tool, is the ENDURA PVD machine made by APPLIED MATERIALS. For example, PVD processes for depositing copper (Cu) and tantalum nitride (Ta(N)) require vacuum, e.g., ~5 mTorr. Throughout this disclosure, "vacuum" refers to pressures much lower than atmospheric (1 atm=760 Torr), e.g., <20 Torr.

Various silicon-wafer semiconductor processing plants ("fabs") use partial pressure analyzers (PPAs), e.g., residual gas analyzers (RGAs), to test vacuum chambers. RGAs perform mass spectrometry on atoms (e.g., argon gas), molecules, or other charged particles in chambers to determine the composition of those molecules or their partial pressures. RGAs can include quadrupole mass spectrometers or other filters to select ions with particular characteristics, and detectors to detect or count the selected ions. RGAs and are widely used for in-situ process monitoring in semiconductor manufacturing, especially in PVD processes. Among the uses of the PPA for CVD or etching processes are: following the process chemistry by monitoring the timing and concentration of input gases; monitoring reaction products; eliminating waste; and assessing the of the process chamber, e.g., by checking for leaks, residual contaminants, contaminants during processing and proper functioning of the tool. PPAs for CVD/etch applications can use a closed ion source (CIS) or an open ion source (OIS). There is a continuing need for improved RGAs or RGA detectors.

BRIEF DESCRIPTION

A detector in a residual gas analyzer (RGA) is configured to receive ions traveling in a downstream direction along a beamline and includes a steering electrode offset from the beamline. A first ion-receiving electrode is at least partly on the opposite side of the steering electrode from the beamline. A second ion-receiving electrode is at least partly offset from the beamline, at least partly across the beamline from at least a portion of the steering electrode, and at least partially upstream of at least a portion of the steering electrode. A shielding electrode is arranged at least partly between the beamline and the second ion-receiving electrode. A source applies a potential to the shielding electrode. A residual gas analyzer (RGA) includes an ion source, an analyzer, and such a detector.

According to various aspects, there is provided a detector in a residual gas analyzer (RGA), the detector configured to receive ions traveling in a downstream direction of a beamline, the detector comprising: a steering electrode offset from the beamline; a first ion-receiving electrode arranged at least partly on the opposite side of the steering electrode from the beamline; a second ion-receiving electrode at least partly offset from the beamline and arranged at least partly across the beamline from at least a portion of the steering electrode and at least partially upstream of at least a portion of the steering electrode; a shielding electrode arranged at least partly between the beamline and the second ion-receiving electrode; and a source for applying a potential to the shielding electrode.

The shielding electrode can be arranged oblique to the beamline. The detector can include an electron multiplier having the first ion-receiving electrode and a channel electrically connected to the first ion-receiving electrode. The detector can include a readout electrode electrically connected to both the first ion-receiving electrode and the second ion-receiving electrode. The detector can include a supply for selectively applying a potential to the first ion-receiving electrode. The first ion-receiving electrode can include a conductive cone having a farthest-downstream collection point and the shielding electrode can extend at least partly upstream of the farthest-downstream collection point. The detector can include a steering supply for selectively applying a potential to the steering electrode. The detector can include a multichannel plate including the steering electrode and having a farthest-downstream collection point. The shielding electrode can extend at least partly upstream of the farthest-downstream collection point. The second ion-receiving electrode can be arranged fully off the beamline. The steering electrode and the shielding electrode can include respective grids.

According to various aspects, there is provided a residual gas analyzer (RGA), comprising an ion source; an analyzer having an aperture, the analyzer defining a beamline passing through the aperture; and a detector configured to receive ions traveling in a downstream direction through the aperture, the detector comprising a steering electrode offset from the beamline; a first ion-receiving electrode arranged at least partly on the opposite side of the steering electrode from the beamline; a second ion-receiving electrode at least partly offset from the beamline and arranged at least partly across the beamline from at least a portion of the steering electrode and at least partially upstream of at least a portion of the steering electrode; a shielding electrode arranged at least partly between the beamline and the second ion-receiving electrode; and a source for applying a potential to the shielding electrode.

The detector can further include an electron multiplier having the first ion-receiving electrode and a collector plate, and a readout electrode electrically connected to both the second ion-receiving electrode and the collector plate, and the RGA can further include a supply for applying a selected potential to the first ion-receiving electrode and a steering supply for applying a selected potential to the steering electrode of the detector. The RGA can include a controller adapted to receive a mode command and operate the supply and the steering supply to direct ions departing the analyzer either towards or away from the first ion-receiving electrode of the electron multiplier in response to the mode command. The analyzer can include a quadrupole mass filter. The steering electrode and the shielding electrode can include respective grids. The first ion-receiving electrode can include a conductive cone having a farthest-downstream collection point and the shielding electrode can extend at least partly upstream of the farthest-downstream collection point. The RGA can include a multichannel plate including the steering electrode and having a farthest-downstream collection point; the shielding electrode can extend at least partly upstream of the farthest-downstream collection point thereof.

According to various aspects, there is provided a detector in a residual gas analyzer (RGA), the detector configured to receive ions traveling in a downstream direction of a beamline, the detector comprising: a readout electrode; a steering electrode arranged offset from the beamline; a steering supply for selectively applying a potential to the steering electrode; an electron multiplier including: a first ion-receiving electrode arranged at least partly on the opposite side of the steering electrode from the beamline and having a farthest-downstream collection point; a collector plate electrically connected to the readout electrode and configured to collect electrons from the first ion-receiving electrode; and a supply configured to selectively apply a voltage to at least part of the first ion-receiving electrode; a Faraday cup including a second ion-receiving electrode electrically connected to the readout electrode, the second ion-receiving electrode arranged at least partly offset from the beamline; at least partly across the beamline from at least a portion of the steering electrode; and at least partially upstream of at least a portion of the steering electrode; a shielding electrode arranged at least partly between the beamline and the second ion-receiving electrode and extending at least partly upstream of the farthest-downstream collection point; and a source for applying a potential to the shielding electrode.

Various aspects advantageously provide increased sensitivity and noise rejection compared to prior schemes. Various aspects advantageously use both an electron multiplier and a Faraday cup to provide effective measurement over a wide range of gas pressures.

This brief description is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

The attached drawings are for purposes of illustration and are not necessarily to scale.

DETAILED DESCRIPTION

Figure 1:
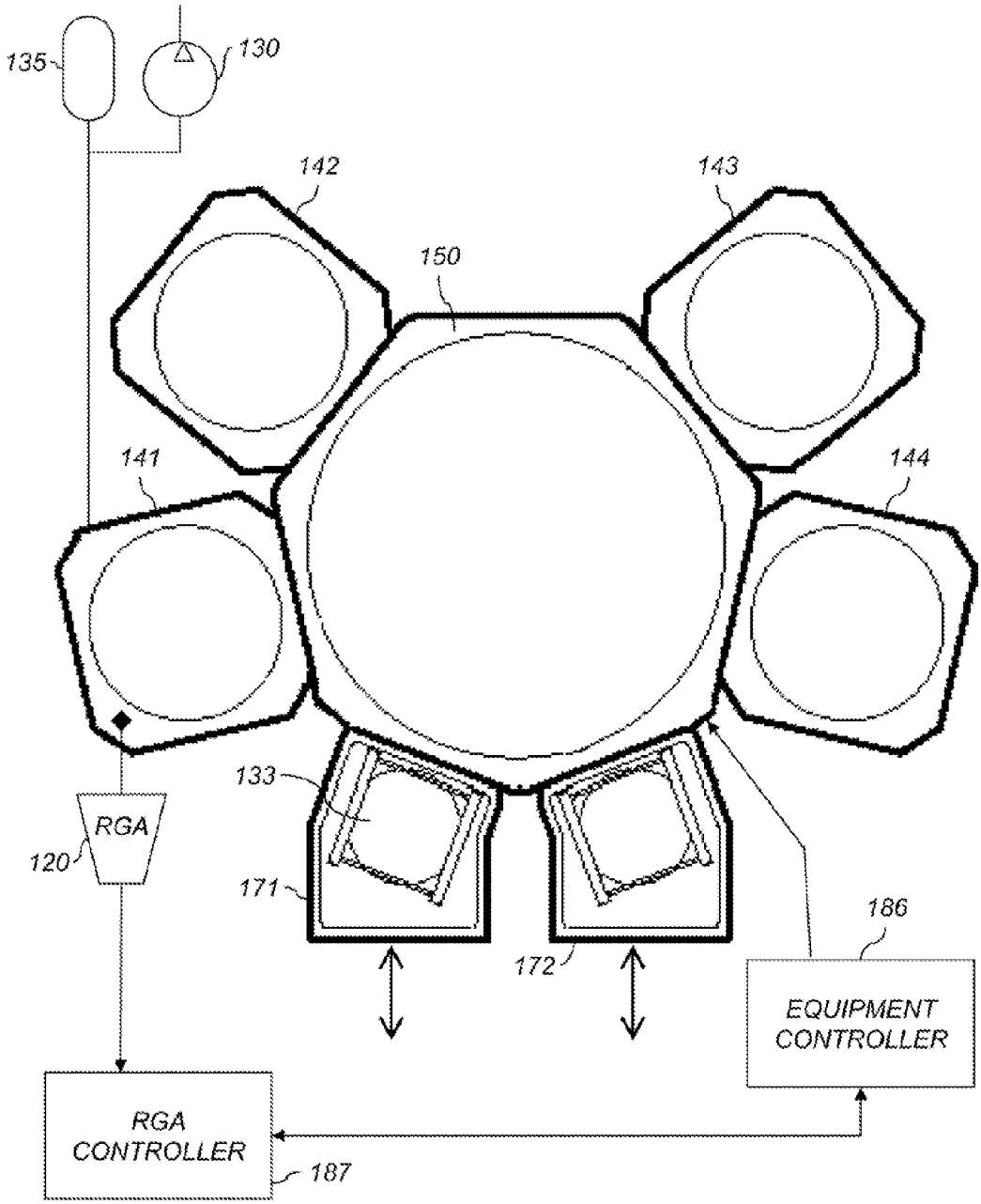
FIG. 1 is a schematic of an exemplary cluster tool and a residual gas analyzer (RGA)

FIG. 1 shows a cluster tool having two load-locks 171, 172. The illustrated cluster tool can be used for semiconductor fabrication. However, it will be understood that vacuum chambers and vacuum systems can be used in the practice of techniques other than semiconductor fabrication, such as techniques in application areas discussed above. Moreover, the cluster-tool configuration is not limiting; linear tools or single vacuum chambers can also be used. In this example, as indicated by the arrows, silicon wafers 133 or other substrates (all referred to herein as "wafers") pass into and out of the tool through the load-locks, which are chambers. Various operations are performed on the wafers in process chambers 141, 142, 143, 144. Wafers are transferred between these chambers by robotic arms or other actuators in the transfer chamber 150. The transfer chamber 150 is kept at extremely low pressure, e.g. less than $10^{-7}$ Torr, by pump 130, e.g., a vacuum pump.

The system includes a mainframe assembly (loadlocks, transfer chamber, process chambers) and an associated set of remote support equipment (RF power supplies, vacuum pumps, heat exchangers, computers). Process chambers can be configured for etching, chemical vapor deposition (CVD), thermal processing, or other processes. Gas supply 135 can supply desired atmospheric components to chamber 1 while pump 130 is operating. In an example, gas supply 135 supplies argon (Ar) gas or nitrogen gas ($N_2$) so that chamber 1 is filled with low-pressure argon or N2 instead of with air. Tools can include 3-4 process chambers around a single central chamber pumped down to ~10 mTorr. During tool idle, gas can be pumped through the chambers to maintain a selected atmosphere.

RGA 120 is configured to measure the atmosphere in chamber 1. RGA 120 has a measurement probe in chamber 1, represented graphically as a diamond shape. Examples of components of RGA 120 are described in U.S. Pat. No. 6,091,068, incorporated herein by reference.

Equipment controller 186 controls the operation of the cluster tool and its chambers, pump 130, and gas supply 135 to carry out a recipe. A "recipe" is a sequence of wafer movements and operations to be performed when a wafer is in a specific chamber. Examples of recipes are given in Herrmann et al, "Evaluating the Impact of Process Changes on Cluster Tool Performance", *IEEE Transactions on Semiconductor Manufacturing* (ISSN 0894-6507), vol. 13, no. 2, May 2000, incorporated herein by reference. Equipment controller 186 can include a microprocessor, microcontroller, programmable-logic device (PLD), programmable logic array (PLA), programmable array logic (PAL), field-programmable gate array (FPGA), application-specific integrated circuit (ASIC), or other computing or logic device programmed, wired, or configured to perform functions described herein. RGA controller 187 is connected to the equipment controller 186. RGA controller 187 or equipment controller 186 can also be connected to a host controller (not shown) via, e.g., SECS communication. The host controller or equipment controller 186 can provide information to RGA controller 187. RGA controller 187 also controls, and collects information from, RGAs 120 and 121. For example, RGA controller 187 can operate supply 235 (FIG. 2), or other power, voltage, or current supplies or sources described herein. In various aspects, equipment controller 186 and RGA controller 187 are two logic modules, subroutines, threads, or other processing components of a single controller.

Examples of residual gas analyzers and measurement techniques used therewith are given in US2003/0008422A1, entitled "Detection of nontransient processing anomalies in vacuum manufacturing process", published Jan. 9, 2003; U.S. Pat. No. 6,468,814B1, entitled "Detection of nontransient processing anomalies in vacuum manufacturing process", published Oct. 22, 2002; U.S. Pat. No. 6,740,195B2, entitled "Detection of nontransient processing anomalies in vacuum manufacturing process", published May 25, 2004; U.S. Pat. No. 7,719,681; US20050256653A1, entitled "Inter-process sensing of wafer outcome", published Nov. 17, 2005; U.S. Pat. No. 7,257,494B2, entitled "Inter-process sensing of wafer outcome", published Aug. 14, 2007; US20090014644A1, entitled "IN-SITU ION SOURCE CLEANING FOR PARTIAL PRESSURE ANALYZERS USED IN PROCESS MONITORING", published Jan. 15, 2009; U.S. Pat. No. 5,850,084A, entitled "Ion lens assembly for gas analysis system", published Dec. 15, 1998; U.S. Pat. No. 5,889,281A, entitled "Method for linearization of ion currents in a quadrupole mass analyzer", published Mar. 30, 1999; U.S. Pat. No. 5,808,308A, entitled "Dual ion source", published Sep. 15, 1998; US20050258374A1, entitled "Replaceable anode liner for ion source", published Nov. 24, 2005; US20020153820A1, entitled "Apparatus for measuring total pressure and partial pressure with common electron beam", published Oct. 24, 2002; U.S. Pat. No. 4,692,630A, entitled "Wavelength specific detection system for measuring the partial pressure of a gas excited by an electron beam", published Sep. 8, 1987; U.S. Pat. No. 4,988,871A, entitled "Gas partial pressure sensor for vacuum chamber", published Jan. 29, 1991; U.S. Pat. No. 6,642,641B2, entitled "Apparatus for measuring total pressure and partial pressure with common electron beam", published Nov. 4, 2003; U.S. RE38138E1, entitled "Method for linearization of ion currents in a quadrupole mass analyzer", published Jun. 10, 2003; U.S. Pat. No. 7,041,984B2, entitled "Replaceable anode liner for ion source", published May 9, 2006; and U.S. Pat. No. 7,443,169, the disclosure of each of which is incorporated herein by reference.

RGA controller 187, equipment controller 186, or both can include or be operatively connected to a memory that stores the recipe for measurements, and can sequence through that recipe. RGA controller 187 can provide instructions to equipment controller 186 to control the valves and other moving parts of the tool. Equipment controller 186 can provide control of the chamber slit valve and other moving parts of the tool and can also provide instructions to RGA controller 187 to control RGAs or RGA pneumatic valves if RGA pneumatic valves are installed. In some cases, the RGA results, such as air leak results for a chamber, can be sent to equipment controller 187 or a host controller (e.g., an industrial PC or HMI) for further action. RGA pneumatic valves can be used to control the flow of gas from the host chamber to the ion source of the RGA.

Figure 2:
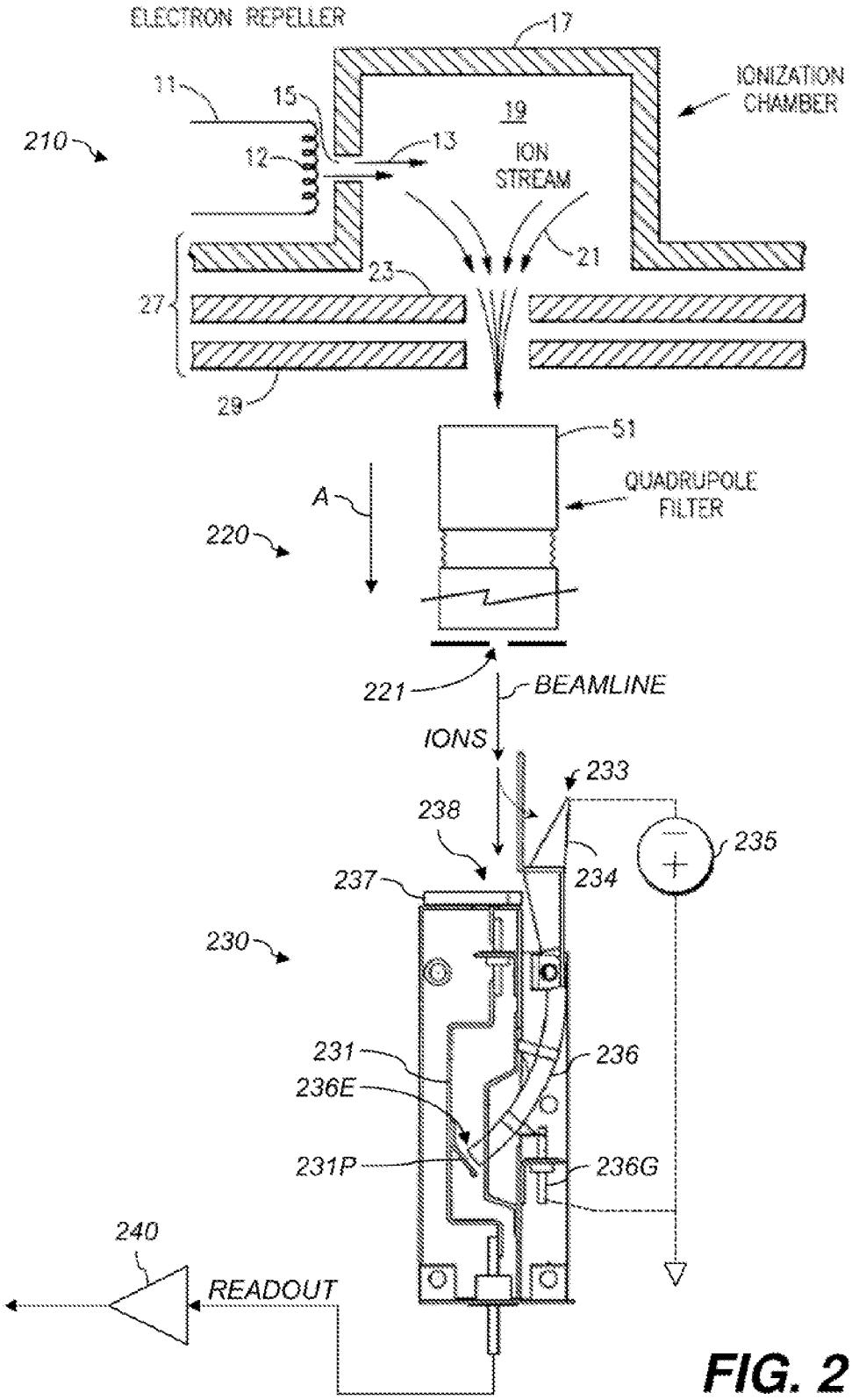
FIG. 2 is a schematic of an RGA according to various aspects.

FIG. 2 is a schematic of an RGA. In this example, electrons produce positive ions that are attracted by negative voltages. Throughout this disclosure, negative ions attracted by positive voltages can also be used. A residual gas analyzer measures the individual partial pressures of gases in a mixture. The RGA system includes a probe (parts 210, 220, 230), which operates under high vacuum, the electronics (e.g., sensor 240), which operate the probe, and software, working in conjunction with an external computer (not shown) to display data and control the electronics. The high vacuum can be provided by a tool such as the cluster tool shown in FIG. 1. The high vacuum can also be provided in a special-purpose chamber designed to hold samples to be measured by the RGA, e.g., for detection of hazardous vapors such as BTEX (benzene, toluene, ethylbenzene, or xylene). The RGA includes ion source 210, analyzer 220, and detector 230. Ion source 210 contains heated filament 12 that emits electrons 13. These electrons collide with gas molecules in the vacuum system (e.g., volume 19), giving them a net electrical charge, i.e., producing ions. A single electron removed from the molecule produces a parent molecular ion. Additionally, multiple charged ions can be formed when sufficient energy of the incident electron releases more than one electron from the molecule or atom. Additionally, sometimes the incident electron has sufficient energy to break chemical bonds and remove electron(s), forming fragment ions.

Analyzer 220 can include, e.g., a linear quadrupole mass filter 51. Ions produced in ion source 210 move into the quadrupole mass filter 51 to be separated according to their mass-to-net-charge ratio. Mass is denoted "m" herein and net charge is denoted "z". References to "mass-to-charge" herein refer to the ratio of mass to net charge, i.e., m/z. In various aspects, RGAs are used to detect charged particles other than traditional ions of atoms, e.g., proteins or viruses with $z>>+1$. For example, small proteins can have $z=10\text{-}20$, larger proteins can have $z=30\text{-}40$, and viruses can have $z>100$. For example, a protein having a mass of 12500 amu and 15 charges would have $m/z=833$. In other aspects, analyzer 220 can include a quadrupole analyzer other than a linear quadrupole mass filter, a magnetic-sector analyzer, an ion trap, or a time-of-flight analyzer.

Ions that have the selected mass-to-charge ratio pass to ion detector 230. Ions that have been transmitted through analyzer 220 strike detector 230, become neutralized, and draw a current that is proportional to—and thus identifies—the gas component present. The RGA electronics module (not shown; can include or be operatively connected to sensor 240), which incorporates a "smart sensor" design, interprets the output of the sensor for display with the system software and an external computer. This system software can be used for process monitoring, statistical process control, and maintenance procedures like mass calibration. Multiple gas components can be analyzed by successively operating the analyzer to sample different m/z ratios. For example, ionic carbon dioxide ($CO_2^+$) has m/z=44, ionic nitrogen gas ($N_2^+$) has m/z=28, and ionic oxygen gas ($O_2^+$) has m/z=32. Argon (Ar) has several isotopes, so measurements of an Ar atmosphere typically show some ions at m/z=36, fewer at m/z=38, and many more at m/z=40.

In various aspects of ion source 210, electron emitter 11 including a filament 12 emits electrons 13 that pass through an opening or slot 15 in an ionization chamber 17 into an ionization volume 19 containing rarified gas. The electrons interact with the gas molecules, ionizing some of them. The ions so produced are accelerated by an ion accelerator 23, and are focused into an ion beam for use by a quadrupole filter 51 or other instrument. An exemplary ion lens assembly 27 includes a series of concentric flat, thin disc-like elements, including an ion accelerator 23 and an exit lens 29 arranged in parallel spaced relation to one end of the ion source, the ion source including an anode having a cylindrical interior which defines the ionization volume 19.

In various aspects of a dual ion source, the dual ion source includes a symmetrical combination of two conventional ion sources sharing a common ion volume. Electrons from a common electron emitter (or separate emitters) enter the ion volume through two openings, forming ions in two locations. Two identical accelerator plates, electrically connected if desired, draw ion beams out of the ionization volume in respective different directions. The first ion beam is directed to a total current collector for measuring total ion pressure of the gas in the ion volume, and a second ion beam is directed to an analyzer, "analyzer" being defined herein as a mass spectrometer, quadrupole filter, or any other instrument that uses or analyzes an ion stream. Further details of ion sources are given in the above-referenced U.S. Pat. No. 5,850,084.

In various aspects, analyzer 220 includes quadrupole mass filter 51. Quadrupole mass filter 51 includes four parallel electrodes (not shown) driven to cause ions to oscillate in component(s) of velocity perpendicular to axis A of the electrodes. The drive waveforms of the electrodes are selected so that ions having other than a selected mass/charge ratio (within a selected tolerance range) will strike one or more electrode(s) and lose charge, or will not be positioned to pass through aperture 221. Note that "aperture" herein refers to the actual opening through which ions pass. Ions that do pass through aperture 221 thus have the selected mass/charge ratio, within the selected tolerances. These ions are referred to herein as "mass selected ions" since they have the mass/charge ratio selected by analyzer 220. The mass selected ions can be detected to determine whether a substance with the selected m/z is present in volume 19. As used herein, "upstream" and "downstream" indicate relative spatial relationships of components. Upstream components are closer to ion source 210 in a direction parallel to axis A than are downstream components. For example, detector 230 is downstream of quadrupole mass filter 51. Ions travel in a generally downstream direction in the RGA. The average travel path of ions through aperture 221 towards detector 230 is referred to herein as a "beamline." Ions, on average, travel from aperture 221 along the beamline towards detector 230, as shown. In an example of an RGA using a quadrupole mass filter and a detector, the beamline of the detector is the extended axis of the quadrupole mass filter. Different ions can have different trajectories; the term "beamline" does not require that every ion travel along exactly the same path or trajectory. Ions, on average, travel in a downstream direction of the beamline, e.g., from analyzer 220 towards detector 230. "Upstream" is the opposite direction from downstream, e.g., from detector 230 towards analyzer 220.

FIG. 2 shows a detector according to various aspects. Detector 230 includes two detection devices: Faraday cup 237 and electron multiplier 233. This and other configurations using both cup and multiplier are referred to herein as "dual-detection" or "EM/FC" configurations. Configurations using cup or multiplier, but not both, are referred to herein as "single-detection" configurations. Faraday cup 237 is an electrode, here a flat plate when viewed from aperture 221 looking toward Faraday cup 237. Ions striking Faraday cup 237 deposit their charge thereon, displacing corresponding charge. The term "cup" does not constrain the shape of Faraday cup 237, except that Faraday cup 237 has a conductive surface positioned to be struck by mass selected ions. The displaced charge flows along readout electrode 231 and can be measured to determine the incidence of ions on Faraday cup 237.

In the example shown, ion source 210 strikes atoms or molecules with electrons, knocking other electrons off those atoms or molecules to produce positive ions. The positive ions travel through analyzer 220 and some strike Faraday cup 237, as indicated by the solid "IONS" arrows. Faraday cup 237 includes one or more panels of conductive material, e.g., metal. When ions strike Faraday cup 237, they draw electrons out of Faraday cup 237, producing a positive conventional current out of Faraday cup 237 on readout electrode 231. Readout electrode 231 is connected to sensor 240, which measures current or integrates current over a selected time and measures the resulting accumulated charge. In some aspects, sensor 240 can count individual current pulses correlated with individual ion impacts, e.g., in very-low-pressure situations. Sensor 240 can include analog or digital electronics. In various aspects, readout electrode 231 is connected through a feedthrough pin (not shown) between the interior and exterior of a vacuum chamber, and sensor 240 is an electrometer.

In various examples, Faraday cup 237 is "on-axis." That is, at least a portion of Faraday cup 237 is along an axis (here, labeled "BEAMLINE") parallel to axis A and passing through aperture 221. This axis is referred to as a "quadrupole axis" in configurations using quadrupole mass filter 51; the quadrupole axis extends substantially down the center of quadrupole mass filter 51. The portion of Faraday cup 237 along the axis is directly in the path of ions from aperture 221. Various on-axis configurations permit capturing a higher percentage of the mass selected ions than various off-axis configurations, e.g., those in which a deflection voltage is not used. Various off-axis configurations are described below. However, the on-axis portion is also in the line of photons, neutral atoms, or molecules passing through aperture 221, which can result in baseline offsets in the signal. The example shown uses an on-axis Faraday cup 237 having on-axis portion 238.

In other examples, Faraday cup 237 is "off-axis." That is, no portion of Faraday cup 237 is directly along axis A from aperture 221. Ions will still be captured, even if supply 235 is disabled (discussed below), because ions exiting aperture 221 do not all travel directly along axis A. Instead, those ions spread out in a way representable by a statistical distribution. An off-axis Faraday cup will capture those mass selected ions that travel towards the cup from aperture 221. Various off-axis cups capture a lower percentage of mass selected ions than various on-axis configurations. However, off-axis configurations are less sensitive to noise. The relative reduction in capture percentage of an off-axis configuration can be mitigated using defection voltages, e.g., as described below.

Faraday cups such as Faraday cup 237 can have long operational lifetimes and are very simple. However, they are not useful for measuring ion impacts that produce currents or charges below the noise limits of sensor 240 (e.g., an electrometer). Moreover, measuring low currents by integrating can require extended measurement times. For measurements of very low currents or more rapid measurements, electron multiplier 233 can be used.

Another detection device shown here is a "channel electron multiplier." Electron multiplier 233 includes cone 234 and one or more channel(s) 236. Cone 234 and channel 236 are electrically conductive. Channel 236 can carry current directly, or can be an enclosure around a smaller electrode, e.g., a tube, that itself carries the current. A high DC voltage is impressed across cone 234 and channel 236 by supply 235. (Throughout this disclosure, references to DC voltage or DC bias can also include AC waveforms with a nonzero DC component.) In the example shown, supply 235 biases the end of cone 234 closest to aperture 221, which end is open, with a negative voltage to attract positive ions, shown by the dotted "IONS" arrow. Electrodes attached to supply 235 are shown dashed in this representation in order to visually distinguish them from the electron multiplier 233 and its components. In an example, the open end of cone 234 is biased to between −800VDC and −3000VDC. The respective exit(s) of multiplier channel(s) 236, in this example at end 236E, are each either at ground or slightly below ground (or another selected reference potential). In the example shown, the exit(s) of multiplier channel(s) 236 are grounded via ground contact 236G, in this example a pin. In this way, each positive ion impact inside cone 234 releases more electrons. Electrons travel down channel 236 to readout electrode 231. The term "cone" does not constrain the shape of electron multiplier 233 except that electron multiplier 233 has a conductive area shaped and biased to spread out mass selected ions so that they do not strike electron multiplier 233 in a single, concentrated area, e.g., of <1 $mm^2$.

An electron multiplier can have a gain (electrons reaching readout electrode 231 per ion hitting cone 234) of $10^3$-$10^7$. However, repeated ion impacts eventually wear out cone 234, requiring progressively higher-magnitude voltages from supply 234 to maintain a desired gain. These higher voltages increase the kinetic energy of electrons on impact with cone 234, accelerating the rate of aging. Using a conical shape for cone 234 spreads out ion strikes in space, increasing the life of electron multiplier 233. Moreover, electron multiplier 233 is subject to noise factors that the Faraday cup 237 is not. Repeated electron production and absorption increases random noise, and noise in supply 235 can couple to the signal. Moreover, the number of electrons released per ion impact in cone 234 is not constant, adding noise to the correlation between electrons measured and ion impacts.

Faraday cup 237 and electron multiplier 233 have different relative advantages. Therefore, in the example shown, Faraday cup 237 and electron multiplier 233 are arranged so that if supply 235 is active, ions will be drawn to, and measured by, electron multiplier 233. If supply 235 is not active or is driven negative (i.e., a positive voltage is present on the open end of cone 234), ions will be drawn to, and measured by, Faraday cup 237. This advantageously permits obtaining the advantages of both measurement devices in a single RGA. Throughout this disclosure, "EM mode" describes a dual-detection RGA detector while it is configured or operated to take measurements using its electron multiplier. "FC mode" describes a dual-detection RGA detector while it is configured or operated to take measurements using its Faraday cup.

In various aspects, readout electrode 231 is connected to both Faraday cup 237 and electron multiplier 233. In various aspects, Faraday cup 237 produces positive conventional currents, since it is measuring positive ion impacts, and electron multiplier 233 produces negative conventional currents, since it is effectively measuring only the repeated electron impacts. In the example shown, readout electrode 231 is mechanically connected to Faraday cup 237. End 236E of channel 236 is open, and electrons thus depart channel 236 at end 236E and strike multiplier signal collector plate 231P, which is part of, or is mechanically and electrically connected to, readout electrode 231. This bombardment moves charge in readout electrode 231, producing a readout signal.

Figure 3:
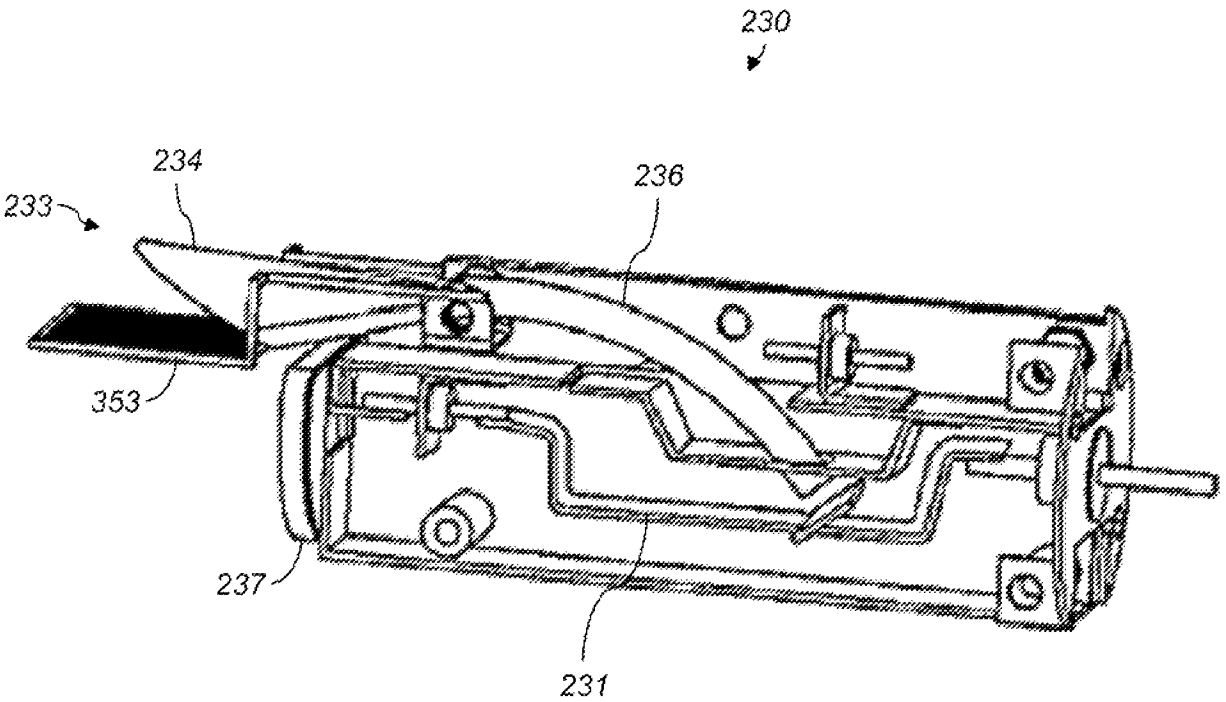
FIG. 3 is a perspective view of the detector shown in FIG. 2.

FIG. 3 is a perspective view of detector 230 (FIG. 2). Electron multiplier 233, cone 234, channel 236, Faraday cup 237, and readout electrode 231 are as shown in FIG. 2. Steering grid 353 is, e.g., a wire mesh, and can be biased to steer ions towards or away from cone 234. For example, when grid 353 is driven negative, it attracts incoming positively-charged mass selected ions away from Faraday cup 237 towards cone 234.

Figure 4:
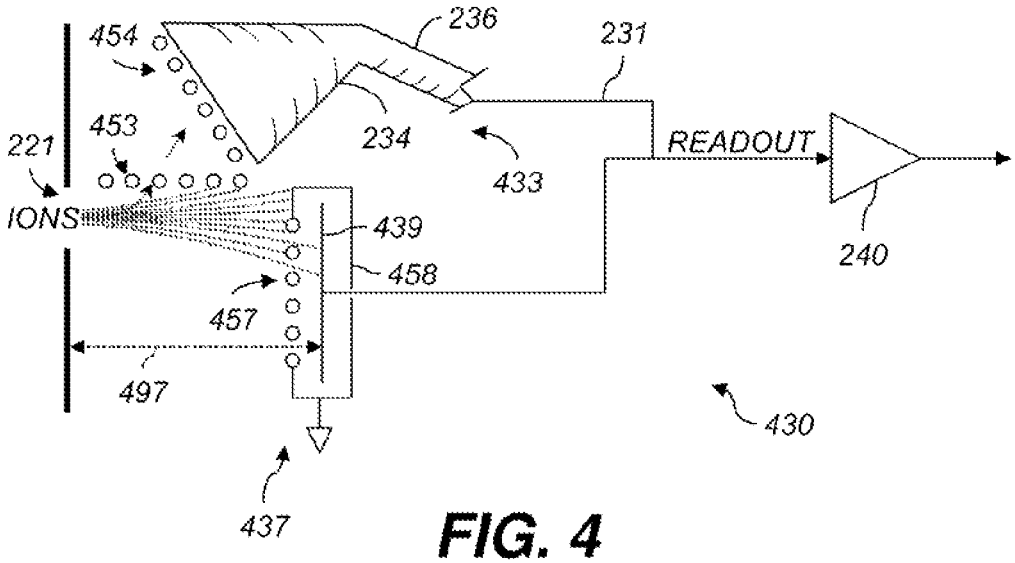
FIGS. 4-6 are schematics of exemplary detectors for RGAs.

FIG. 4 shows portions of an exemplary detector 430. Aperture 221, cone 234, channel 236, and sensor 240 are as shown in FIG. 2. The fanning-out dotted lines from aperture 221 are mass selected ions, shown fanning out as they would in an example when no high voltages are applied, e.g., to a steering electrode such as grid 453, discussed below. Detector 430 has electron multiplier 433 offset from the beamline, and has on-axis Faraday cup 437. In this example, Faraday cup 437 extends away from the beamline opposite cone 234 of electron multiplier 433. Other configurations can also be used.

Grid 453 is arranged offset from, and parallel to the beamline. Grid 453 is represented graphically as a set of spaced-apart circles, indicating that grid 453 includes a plurality of spaced-apart electrodes or other electrically-conductive segments. Examples of grid 453 include an array of parallel, spaced-apart wires; two arrays set at angles to form a grid; or a conductive sheet such as a metal sheet with a plurality of holes cut out of it. The electrodes or segments of grid 453 are electrically connected to a DC supply, e.g., supply 235 (FIG. 2) (referred to herein as a "steering supply"). Grid 453 is an example of a steering electrode that steers the ions. Specifically, when the steering supply is active, grid 453 attracts mass selected ions, diverting them off the beamline and steering them towards cone 234 of electron multiplier 433. When the steering supply is not active, grid 453 does not steer ions. Grid 453 can also be driven positive by the steering supply to divert ions off the beamline and towards Faraday cup 437. In various aspects, a grid 454 is arranged in front of cone 234 of electron multiplier 433. Grid 454 can also be connected to the DC supply to direct ions into cone 234.

Faraday cup 437 includes a plate 439 electrically connected to a readout electrode 231. Faraday cup 437 also includes grid 457 and shield 458 electrically connected thereto. Grid 457 and shield 458 are held at a selected potential, e.g., are grounded, and enclose plate 439, which can be any shape. Plate 439 is an example of an ion-receiving electrode. Grid 457 is arranged facing upstream.

In the FC mode of detector 430, grid 453 (the steering electrode) is either disabled or operated at a positive voltage. As a result, mass selected ions travel towards Faraday cup 437 and thus towards grid 457. Some of the ions strike grid 457 and are absorbed by a potential source electrically connected to grid 457, e.g., a ground tie. Others of the ions pass through openings in grid 457 and strike plate 439, producing current on readout electrode 231 electrically connected to plate 439.

In the EM mode of detector 430, ions are directed away from Faraday cup 437. However, electric fields are still present near Faraday cup 437, e.g., the field provided by the voltage on grid 453, the steering electrode. Grid 457 and shield 458 advantageously reduce coupling of high-voltage noise from one or more voltage supplies connected to grid 453 and cone 234 (e.g., a DC steering supply or an electron-multiplier cone supply) into plate 439. This, in turn, advantageously reduces coupling of noise onto readout electrode 231 via plate 439 while detector 430 is operating in the EM mode.

This configuration shown in FIG. 4 provides dual detection with reduced noise coupling compared to a system without grid 457 in Faraday cup 437. Additionally, grid 453 (the steering electrode) permits detector 430 to be reduced in size compared to a system without grid 453, since the additional ion optics provided by grid 453 permit running cone 234 at lower voltages in the EM mode and still steering ions effectively. That is, without grid 453, the electric field to steer ions towards electron multiplier 433 would need to be provided by a high voltage applied to cone 234. With grid 453, some of the field is provided by the voltage applied to grid 453, reducing the magnitude of the electric field to be produced by cone 234, and thus permitting a reduction of the voltage on cone 234 for a given performance level compared to a system without grid 453.

However, in this configuration, plate 439 is spaced apart from aperture 221. The distance between plate 439 and aperture 221 along the beamline is shown as distance 497. The larger distance 497 is, the smaller the percentage of ions captured by plate 497, since the ions spread out as indicated by the dotted "IONS" lines. In an example, Faraday cup 437 misses half of the mass selected ions, so has a sensitivity of, e.g., 0.5 mA/torr, compared to an FC-only single-detection detector with a sensitivity of, e.g., 1.0 mA/torr. There is, therefore, a continuing need for a detector that has reduced noise coupling and also higher sensitivity (correlated with percentage mass selected ion capture) than in prior schemes.

Figure 5:
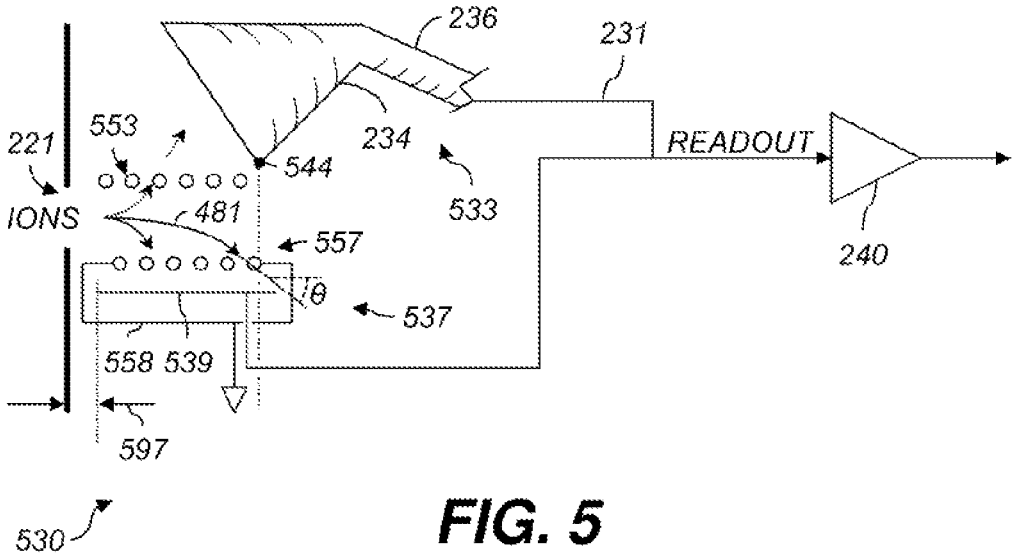

FIG. 5 shows a detector 530 according to various aspects. Aperture 221, cone 234, channel 236, and sensor 240 are as shown in FIG. 2. Detector 530 has electron multiplier 533 and off-axis Faraday cup 537 arranged on opposite sides of the beamline.

Detector 530 includes grid 553, which is another example of a steering electrode, arranged at least partly between the beamline and cone 235 of electron multiplier. Grid 553 can have a mechanical design as discussed above with reference to grid 453 (FIG. 4). Grid 553 is connected to a steering supply that can provide positive or negative voltages. In EM mode, the supply provides negative voltages (e.g., −600VDC to −2500VDC), and grid 553 directs mass selected ions towards cone 234 of electron multiplier 533, represented by the dotted IONS arrow.

In FC mode, the supply provides positive voltages (e.g., +100VDC to +250VDC), and grid 553 directs mass selected ions represented by the solid IONS arrows toward plate 539, which is another example of an ion-receiving electrode. In this example, plate 539 is arranged on the opposite side of the beamline from grid 553, the steering electrode. This configuration advantageously provides increased sensitivity than a conventional off-axis cup, without incurring some drawbacks of an on-axis cup. Grid 557 and shield 558 surround plate 539 and are grounded or held at another fixed bias, as discussed above with reference to grid 457 and shield 458 (FIG. 4). This can be done, e.g., using a low-impedance connection to a selected potential, or using a source of electrical potential such as a DC voltage supply. Grid 557 is an example of a shielding electrode. Distance 597 is the distance between plate 539 and aperture 221 along the beamline. Distance 597 is much less than distance 497 (FIG. 4), which also increases the sensitivity. Plate 539 can include any number of segments, mechanically connected or not, shaped or oriented in any way, to be struck by ions and transfer corresponding charge to readout electrode 231.

Point 544 is a "farthest-downstream collection point." As used herein, the term "farthest-downstream collection point" refers to the point on cone 234 (or another ion-receiving electrode) farthest from aperture 221 along the beamline (e.g., axis A) at which ions can be collected, i.e., the farthest-downstream point on the opening of cone 234 to the ions. As shown, plate 539, grid 557, and shield 558 are partially upstream of point 544 and partially downstream. In an example, the ion-receiving electrode (plate 539) is at least partially upstream of at least a portion of the steering electrode 553. Other examples of this spatial relationship are shown in FIGS. 5 and 6.

The dashed lines show angle θ, the angle between an ion travelling on ion path 481 and the plane of grid 557. Angle θ is discussed further below with reference to FIG. 6. Sensitivity increases as θ approaches 90°, since at 90° the smallest number of ions will strike grid 557 rather than plate 539. This is also discussed below.

Figure 6:
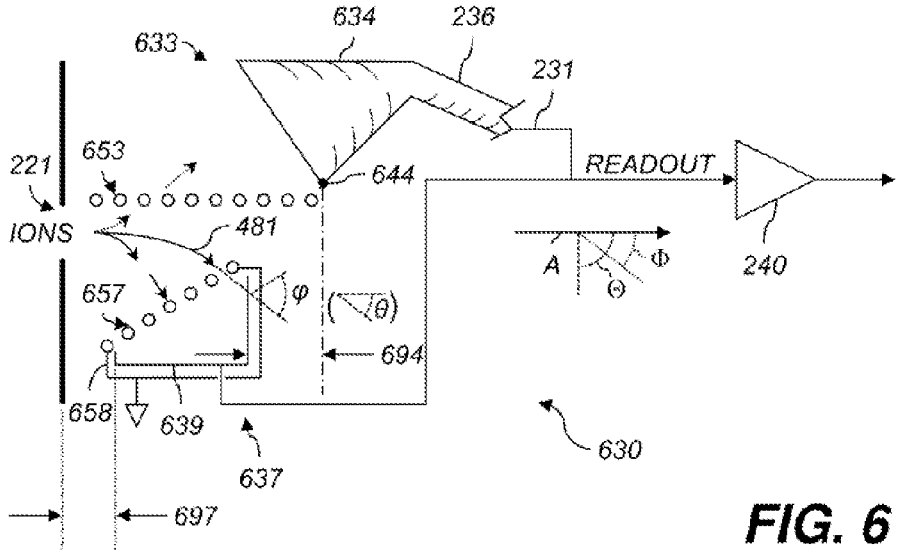

FIG. 6 shows another detector 630 according to various aspects. Aperture 221, channel 236, and sensor 240 are as shown in FIG. 2. Grid 553 is as shown in FIG. 5. Detector 630 has electron multiplier 633 and Faraday cup 637 arranged on opposite sides of the beamline. Grid 653 is arranged between the beamline and cone 634 of electron multiplier 633. Grid 653 is a steering electrode that can be driven to direct ions toward electron multiplier 633 or Faraday cup 637.

Faraday cup 637 includes plate 639, which mass selected ions impact. Plate 639 is yet another example of an ion-receiving electrode. Faraday cup 637 can be on-axis or off-axis. In the example shown, the ion-receiving electrode (plate 639) is offset from the beamline opposite the steering electrode (grid 653).

Plate 639 is surrounded by shield 658 except on one or more surface(s) facing aperture 221 (directly or obliquely). Grid 657, which is an example of a shielding electrode, is arranged at least partly between aperture 221 and those surface(s). Grid 657 and shield 658 surround plate 639 and are grounded or held at a selected bias, as discussed above.

Grid 657 is substantially not parallel to the beamline axis A. Grid 657 is inclined to face aperture 221, i.e., the normal to grid 657 on the side opposite plate 639 has a component pointing upstream. This provides improved ion optics, since ions from aperture 221 approach grid 657 more nearly normal to grid 657. The dashed lines show angle ϕ, the angle between an ion travelling on ion path 481 and the plane of grid 657. Angle ϕ is closer to 90° than is angle θ (FIG. 5); angle θ is shown in parentheses for comparison. Therefore, a higher percentage of mass selected ions will pass through grid 657 than through grid 557 (FIG. 5), all else being equal. This is because the individual elements (e.g., wires) that make up grids 557, 657 have thickness (are not one-dimensional). As a result, the more obliquely the ions approach the grid, the lower percentage of the area perpendicular to the ion path is available for the ion to travel through. In the limit, an ion could not pass grid 557 if angle θ were 90° (ions approaching the edge of the grid rather than the face thereof). In an example, grids 557, 657 are made of the same elements (e.g., wires with substantially circular cross-sections), arranged the same way with the same spacing. Since angle $\phi$ is closer to 90° than is angle $\theta$, a higher percentage of the area of grid 657 is available for ion passage than of grid 557. Detector 630 therefore provides improved sensitivity compared to detector 530. Distance 697 is the distance between plate 639 and aperture 221 along the beamline. Distance 697 is smaller than distance 497, providing detector 630 improved sensitivity compared to detector 430.

As discussed above, detector 630 includes grid 653, which is a further example of a steering electrode. A lower-magnitude voltage can advantageously be applied by a steering supply to grid 653 in FIG. 6 to turn ions than is applied to grid 553 in FIG. 5, for a given sensitivity. This is because the angle $\Phi$ through which the electrons have to turn to be normal to the plane of grid 657 (FIG. 6) is less than the angle $\Theta$ through which the electrons have to turn to be normal to the plane of grid 557 (FIG. 5). Therefore, a lower magnitude of electric field is required, and thus a lower magnitude of voltage. This lower-magnitude voltage reduces noise coupled from the DC supply in FC mode. This is particularly important at very low currents. In various aspects, a multi-channel plate (MCP) electron multiplier is used instead of the channel electron multiplier (e.g., as discussed below with reference to FIGS. 9 and 10). Increasing the distance between plate 639 and the high voltage on grid 653 or cone 634 also reduces noise, but can reduce collection efficiency if plate 639 is less in the direct path of ions from aperture 221.

Still referring to FIG. 6, in aspects shown here, plate 639 has two vertical segments and one horizontal segment. Plate 639 can have any number of segments in any orientation or shape, including curves. At least one segment can be an on-axis segment, or no segment can be an on-axis segment. Each segment can be parallel to grid 657, parallel to axis A, or oriented differently. The distance perpendicular to axis A between any segment and the center of aperture 221 can be selected, as can the angle of grid 657 with respect to axis A.

In this paragraph, detector 630 is considered from the point of view of a mass-selected ion leaving aperture 221 and traveling parallel to beamline axis A (FIG. 2) down the centerline of aperture 221 (an "ion's view"). Grid 653 and cone 633 are ahead and above; grid 657 is ahead and below. Plate 639 can have any number and orientation of segments, as discussed above. Plate 639 can have a back segment substantially perpendicular to axis A, positioned either on-axis (the top edge of the back segment is straight ahead) or off-axis (the top edge of the back segment is below straight-ahead, so the ion will pass above the back segment if undeflected). Plate 639 can have a bottom segment (a "floor" from this viewpoint) or not, and can have sidewalls to the left and right, or not. Any segment can be parallel to axis A (e.g., left and right walls and a floor; in three-space, an infinite number of planes are parallel to axis A) or not (e.g., plate 639 can be a truncated pyramid turned on its side so the truncated narrow face is downstream of the base, and with the base removed and the side that faces up after turning removed). Plate 639 can include only the depicted horizontal segment. Plate 639 can have left and right sides and a back (far side), but no bottom. In various aspects of off-axis Faraday cups used with quadrupole mass filters 51 (FIG. 2), no part of the Faraday cup is located along an axis parallel to axis A and within a radius of aperture 221 of the quadrupole axis.

Figure 8:
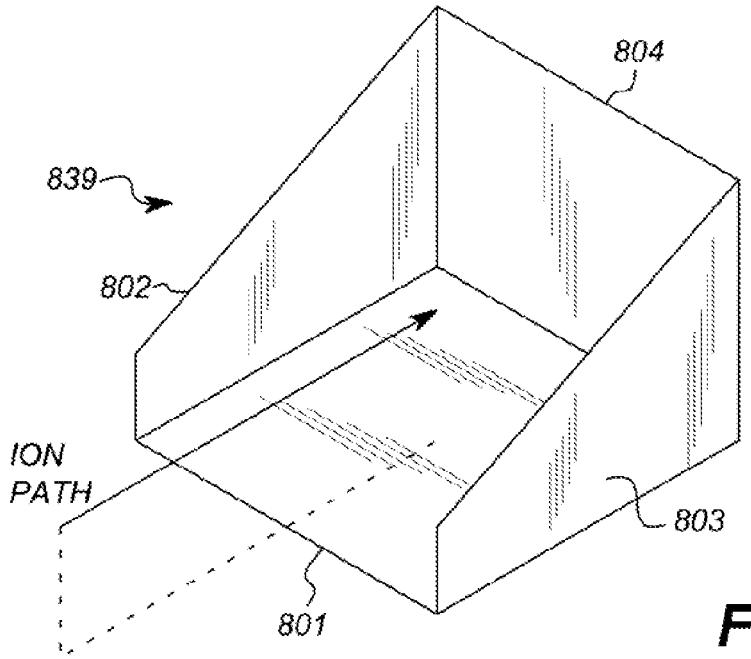
FIG. 8 is an axonometric view of an electrode in a detector for an RGA according to various aspects.

FIG. 8 is an axonometric view of electrode 839 according to various aspects. Electrode 839 has, in "ion's view," bottom 801, left side 802, right side 803, and back 804. The dashed lines show the projection of the shown ion path on the plane of bottom 801. Electrode 839 is an example of an ion-receiving electrode such as plate 639.

Referring back to FIG. 6, electron multiplier 633 has cone 634 and channel 236. In various aspects, cone 634 has farthest-downstream collection point 644 (ions travel generally downstream, as discussed above with reference to FIG. 2). Farthest-downstream collection point 644 is the farthest-downstream point at which cone 634 can collect ions, as discussed above with reference to point 544. Farthest-downstream collection point 644 represents multiple points, if cone 634 has a straight edge perpendicular to axis A at its farthest-downstream extent. In various aspects, farthest-downstream collection point 644 is farther downstream, or no farther upstream, than any point on plate 639 or any segment thereof. This is represented graphically by the dash-dot line extending from farthest-downstream collection point 644 perpendicular to axis A in the plane of the figure. Distance 694 is the distance by which farthest-downstream collection point 644 is downstream of plate 639, or any segment thereof, and can be nonnegative or positive. In various aspects, farthest-downstream collection point 644 is farther downstream, or no farther upstream, than any point on shield 658, or than any point on grid 657.

In various aspects, plate 639 extends at least partially upstream of farthest-downstream collection point 644. Faraday cup 637 is off-axis, and a high magnitude bias is applied to grid 653 to steer ions into Faraday cup 637. In some of these aspects, plate 639 includes left and right walls (not shown) as discussed above in the "ion's-view" paragraph.

Figure 7:
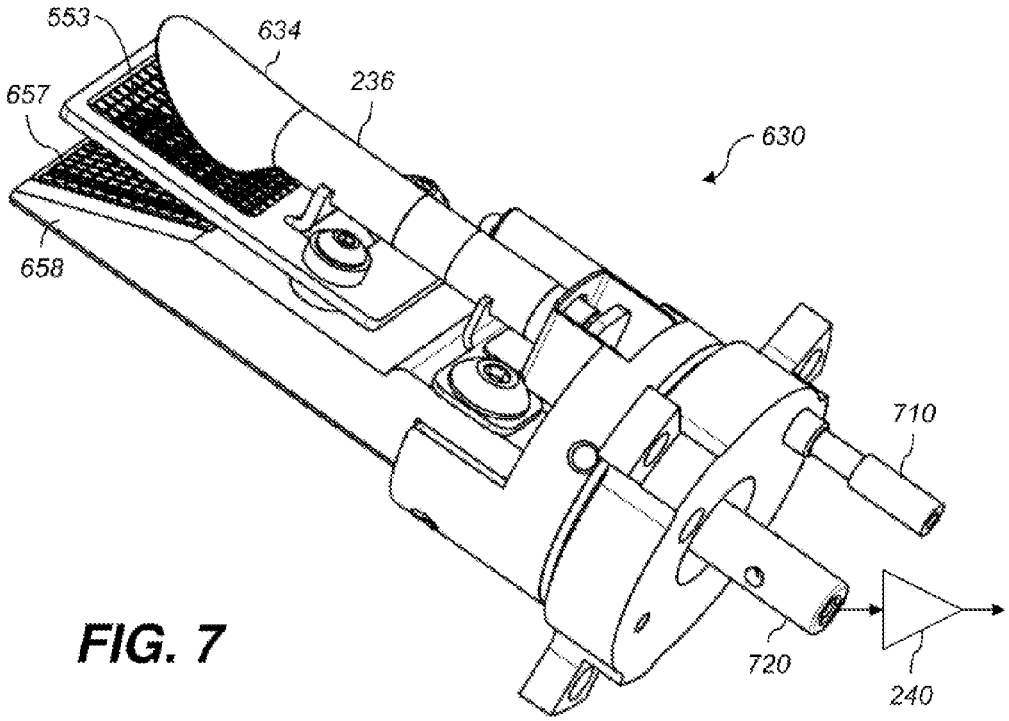
FIG. 7 is a perspective view of a detector for an RGA, and a schematic of related components, according to various aspects.

FIG. 7 is a perspective view of detector 630 shown in FIG. 6. Detector 630, cone 634, channel 236, grid 653, grid 657, and shield 658 are as shown in FIG. 6. Various aspects of detector 630 provide improved sensitivity because plate 639 is closer to aperture 221 than in previous systems. They provide improved noise rejection because plate 639 is shielded. They also provide improved sensitivity because grid 657 is set at an angle so is more nearly perpendicular to the ion stream, reducing the number of ions that strike grid 657 compared to the number that strike plate 639.

FIG. 7 also shows mounting features of detector 630. Connector 710 carries high voltage for cone 634 and grid 653. Connector 720 is electrically connected to readout electrode 231 to carry the signal to sensor 240. This is discussed below with reference to FIG. 11.

An experiment was performed to test an inventive detector similar to that shown in FIGS. 6 and 7 against various comparative detectors. The experiment involved two different test systems. For each test system, performance of an FC-only detector was measured, and performance of the FC mode of an EM/FC detector was measured. Performance was measured as the average sensitivity, reported below in mA/torr. The results were:

TABLE 1

| (mA/torr) | FC-only | FC mode of EM/FC |
|---|---|---|
| System 1 | 0.51 (comparative) | 0.29 (comparative) |
| System 2 | 1.8 (comparative) | 1.7 (inventive) |

As shown, in System 1, the FC mode was noticeably less sensitive than the FC-only detector. However, with the inventive detector implemented in System 2, the FC mode provides substantially the same sensitivity as the FC-only detector in System 2. Moreover, the inventive detector provides a significant increase in sensitivity compared to either detector in System 1.

Figure 9:
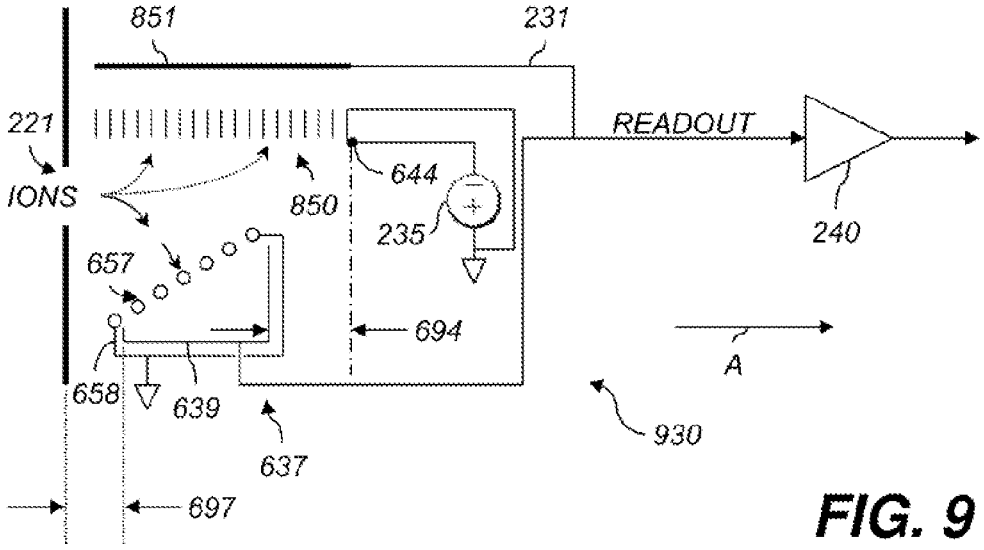
FIG. 9 is a schematic of a detector for an RGA according to various aspects.

FIG. 9 is a schematic of detector 930 according to various aspects. Aperture 221, Faraday cup 637 with grid 657, shield 658, and plate 639, readout electrode 231, and sensor 240 are as shown in FIG. 6. Instead of a channel electron multiplier as in FIGS. 2-7, multichannel plate electron multiplier 850 is used. Electron multiplier 850 includes a plurality of conductive channels oriented vertically (in this figure). Supply 235 applies a negative DC bias to the ends of the channels closest to aperture 221. The opposite ends of the channels (top ends in this figure) are grounded or held at a lower-magnitude bias. In each channel, an electron-multiplication process takes place that is analogous to the process in channel electron multipliers (e.g., multiplier 633, FIG. 6). The accelerated electrons emerge from the tops of the channels and at least some strike collector 851, e.g., a conductive plate. Current then flows to or from collector 851 via readout electrode 231, and is measured by sensor 240. Examples are given in the above-referenced U.S. Pat. No. 6,091,068.

Figure 10:
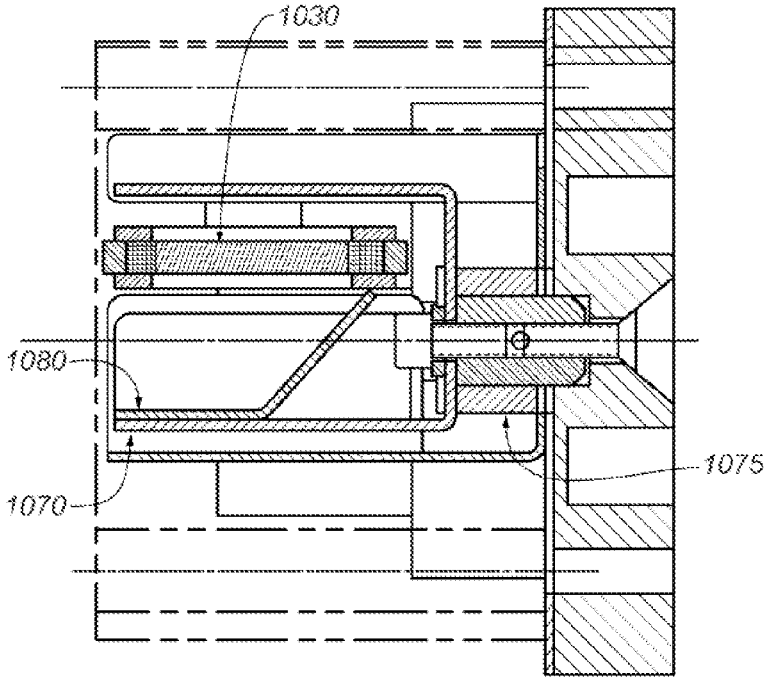
FIG. 10 is a side elevational cross-section of an exemplary detector for an RGA.

FIG. 10 is an elevational cross-section of an exemplary detector. The detector has a multichannel plate 1030, a Faraday cup 1070, a Faraday-cup spacer 1075, and a deflector 1080. The Faraday cup 1070 includes the conductive deflector 1080 on the centerline (dash-dot line) of analyzer 220 (FIG. 2). Deflector 1080 shapes the electric field in EM mode (and can thereby improve ion collection efficiency), and can collect ions directly (on-axis) in FC mode.

Figure 11:
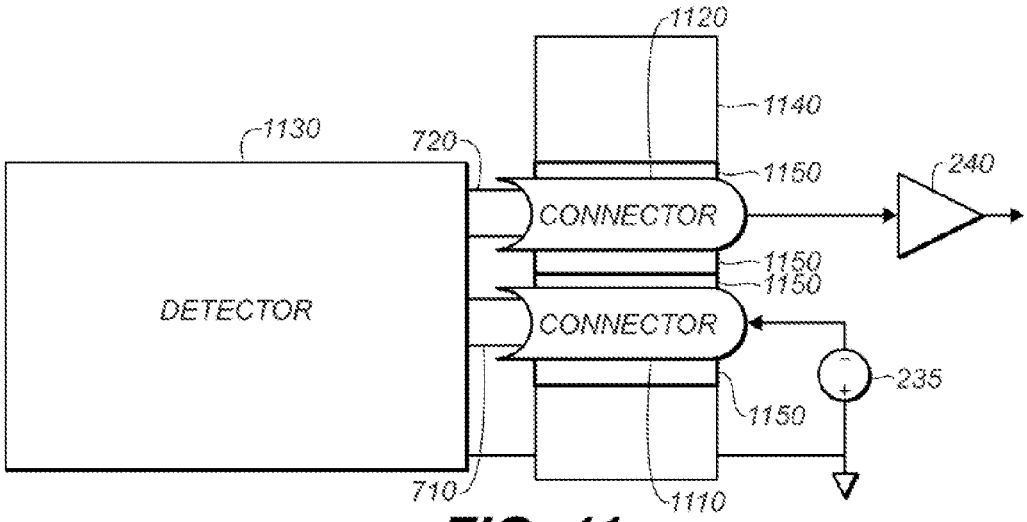
FIG. 11 is a schematic of an exemplary detector for an RGA, a feedthrough, and related components according to various aspects.

FIG. 11 shows mounting features of an detector 1130. Connector 710 carries high voltage and connector 720 carries the readout signal for sensor 740. Feedthrough 1140 is the mechanical feature that seals the (e.g., 2.75") port in the sidewall of a vacuum chamber. This port permits the sensor portion of the RGA (including the ion source, analyzer (e.g., quadrupole mass filter, and ion detector or collector) to be installed in the vacuum to be measured. Feedthrough 1140 includes connectors 1110, 1120 that mate with connectors 710, 720 of detector 1130, respectively. This permits detector 1130 to be installed and removed without having to, e.g., break welds on the feedthrough. Supply 235 is connected to connector 1110 and sensor 240 is connected to connector 1120. In various aspects, feedthrough 1140 and the case of detector 1130 are grounded, as indicated by the ground ties in FIG. 11 (e.g., grounded by direct mechanical contact between conductive cases of each). In various aspects, connectors 710, 720 are receptacles with spring contacts and connectors 1110, 1120 are pins. In various aspects, connectors 1110, 1120 are insulated from each other and from the grounded sections of feedthrough 1140 by insulators 1150, e.g., annular electrical insulators around pin connectors 1110, 1120.

The invention is inclusive of combinations of the aspects described herein. References to "a particular aspect" (or "embodiment") and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to "method" or "methods" and the like is not limiting. The word "or" is used in this disclosure in a non-exclusive sense, unless otherwise explicitly noted.

The invention has been described in detail with particular reference to certain preferred aspects thereof, but it will be understood that variations, combinations, and modifications can be effected by a person of ordinary skill in the art within the spirit and scope of the invention.

The invention claimed is:

1. A detector in a residual gas analyzer (RGA), the detector configured to receive ions traveling in a downstream direction of a beamline, the detector comprising:

a) a steering electrode offset from the beamline;

b) a first ion-receiving electrode arranged at least partly on the opposite side of the steering electrode from the beamline;

c) a second ion-receiving electrode at least partly offset from the beamline and arranged at least partly across the beamline from at least a portion of the steering electrode and at least partially upstream of at least a portion of the steering electrode;

d) a shielding electrode arranged at least partly between the beamline and the second ion-receiving electrode; and e) a source for applying a potential to the shielding electrode.

2. The detector according to claim 1, wherein the shielding electrode is arranged oblique to the beamline.

3. The detector according to claim 1, further including an electron multiplier having the first ion-receiving electrode and a channel electrically connected to the first ion-receiving electrode.

4. The detector according to claim 1, further including a readout electrode electrically connected to both the first ion-receiving electrode and the second ion-receiving electrode.

5. The detector according to claim 1, further including a supply for selectively applying a potential to the first ion-receiving electrode.

6. The detector according to claim 1, wherein the first ion-receiving electrode includes a conductive cone having a farthest-downstream collection point and the shielding electrode extends at least partly upstream of the farthest-downstream collection point.

7. The detector according to claim 1, further including a steering supply for selectively applying a potential to the steering electrode.

8. The detector according to claim 1, further including a multichannel plate including the steering electrode and having a farthest-downstream collection point.

9. The detector according to claim 8, wherein the shielding electrode extends at least partly upstream of the farthest-downstream collection point.

10. The detector according to claim 1, wherein the second ion-receiving electrode is arranged fully off the beamline.

11. The detector according to claim 1, wherein the steering electrode and the shielding electrode include respective grids.

12. A residual gas analyzer (RGA), comprising:

a) an ion source;

b) an analyzer having an aperture, the analyzer defining a beamline passing through the aperture; and c) a detector configured to receive ions traveling in a downstream direction through the aperture, the detector comprising:

i) a steering electrode offset from the beamline;

ii) a first ion-receiving electrode arranged at least partly on the opposite side of the steering electrode from the beamline;

iii) a second ion-receiving electrode at least partly offset from the beamline and arranged at least partly across the beamline from at least a portion of the steering electrode and at least partially upstream of at least a portion of the steering electrode;

iv) a shielding electrode arranged at least partly between the beamline and the second ion-receiving electrode; and v) a source for applying a potential to the shielding electrode.

13. The RGA according to claim 12, wherein:

a) the detector further includes an electron multiplier having the first ion-receiving electrode and a collector plate, and a readout electrode electrically connected to both the second ion-receiving electrode and the collector plate; and b) the RGA further includes a supply for applying a selected potential to the first ion-receiving electrode and a steering supply for applying a selected potential to the steering electrode of the detector.

14. The RGA according to claim 13, further including a controller adapted to receive a mode command and operate the supply and the steering supply to direct ions departing the analyzer either towards or away from the first ion-receiving electrode of the electron multiplier in response to the mode command.

15. The RGA according to claim 13, wherein the analyzer includes a quadrupole mass filter.

16. The RGA according to claim 12, wherein the steering electrode and the shielding electrode include respective grids.

17. The RGA according to claim 12, wherein the first ion-receiving electrode includes a conductive cone having a farthest-downstream collection point and the shielding electrode extends at least partly upstream of the farthest-downstream collection point.

18. The RGA according to claim 12, further including a multichannel plate including the steering electrode and having a farthest-downstream collection point.

19. The RGA according to claim 18, wherein the shielding electrode extends at least partly upstream of the farthest-downstream collection point.

20. A detector in a residual gas analyzer (RGA), the detector configured to receive ions traveling in a downstream direction of a beamline, the detector comprising:

a) a readout electrode;

b) a steering electrode arranged offset from the beamline;

c) a steering supply for selectively applying a potential to the steering electrode;

d) an electron multiplier including:

i) a first ion-receiving electrode arranged at least partly on the opposite side of the steering electrode from the beamline and having a farthest-downstream collection point;

ii) a collector plate electrically connected to the readout electrode and configured to collect electrons from the first ion-receiving electrode;

iii) and a supply configured to selectively apply a voltage to at least part of the first ion-receiving electrode;

e) a Faraday cup including a second ion-receiving electrode electrically connected to the readout electrode, the second ion-receiving electrode arranged at least partly offset from the beamline, at least partly across the beamline from at least a portion of the steering electrode, and at least partially upstream of at least a portion of the steering electrode;

f) a shielding electrode arranged at least partly between the beamline and the second ion-receiving electrode and extending at least partly upstream of the farthest-downstream collection point; and g) a source for applying a potential to the shielding electrode.

* * * * *